US005108306A

United States Patent [19]

Wellinsky

[11] Patent Number: 5,108,306

[45] Date of Patent: Apr. 28, 1992

[54] METHOD AND APPARATUS FOR PROVIDING CABLE STRAIN RELIEF IN AN ELECTRICAL CONNECTOR ASSEMBLY

[75] Inventor: Wayne Wellinsky, Moore, S.C.

[73] Assignee: Thomas & Betts Corporation, Bridgewater, N.J.

[21] Appl. No.: 707,728

[22] Filed: May 30, 1991

[51] Int. Cl.[5] ..... H01R 4/24

[52] U.S. Cl. ..... 439/404; 439/417

[58] Field of Search ..... 439/389–425

[56] References Cited

U.S. PATENT DOCUMENTS

| | | | |
|---|---|---|---|
| 2,794,155 | 5/1957 | Jones | 317/120 |
| 3,355,699 | 11/1967 | Oshva | 339/99 |
| 3,748,628 | 7/1973 | Reimer | 339/17 |
| 3,813,634 | 5/1974 | Wigby et al. | 339/17 |
| 3,966,293 | 6/1976 | Mathe et al. | 339/103 |
| 4,006,957 | 2/1977 | Narozny et al. | 339/103 |
| 4,025,142 | 5/1977 | Huber et al. | 339/128 |
| 4,111,512 | 9/1978 | Parmer et al. | 439/404 |
| 4,295,704 | 10/1981 | Narozny et al. | 439/404 |
| 4,305,635 | 12/1981 | Navarro | 339/99 |
| 4,460,229 | 7/1984 | Matthews | 339/99 |
| 4,484,791 | 11/1984 | Johnson | 439/404 |
| 4,880,395 | 11/1989 | Ericksson et al. | 439/507 |
| 4,913,660 | 4/1990 | Hirai | 439/396 |
| 4,925,401 | 5/1990 | Fogg et al. | 439/465 |
| 4,932,892 | 6/1990 | Hatch | 439/395 |
| 4,938,711 | 7/1990 | Davis et al. | 439/405 |
| 5,011,430 | 4/1991 | Haitmanek | 439/456 |

FOREIGN PATENT DOCUMENTS 0168048 10/1984 Fed. Rep. of Germany ..... 23/66

OTHER PUBLICATIONS

#30685 Insulation Displacement Connection (IDC) with push/pull tab on the Strain Relief, "Research Disclosure", Oct. 1989, No. 306.

*Primary Examiner*—Joseph H. McGlynn

*Attorney, Agent, or Firm*—Robert M. Rodrick; Salvatore J. Abbruzzese

[57] ABSTRACT

An electrical connector assembly for terminating flat multiconductor ribbon cable includes a socket connector and a mating header connector. The socket connector includes a base supporting plural insulation piercing contacts and a cover which is movably supported over the base to effect termination of the cable to the contacts. A pull-tab strain relief member is provided which is movably supported over the cover. The pull-tab strain relief member includes a containment bar for supporting a further transverse extent of the cable between the containment bar and the cover. The pull-tab strain relief member also includes a slot through which an end portion of the cable is inserted. The connector assembly permits daisy-chain connections to be made along the length of the cable.

14 Claims, 3 Drawing Sheets

METHOD AND APPARATUS FOR PROVIDING CABLE STRAIN RELIEF IN AN ELECTRICAL CONNECTOR ASSEMBLY

FIELD OF THE INVENTION

The present invention relates generally to an electrical connector assembly which terminates flat multiconductor ribbon cable. More particularly, the present invention relates to an insulation displacing electrical connector assembly which provides for strain relief of the cable terminated thereto and the method of providing such strain relief.

BACKGROUND OF THE INVENTION

It has long been known that when terminating flat multiconductor ribbon cable with insulation displacing connectors, cable strain relief should be provided so as to minimize the adverse effects of strain placed on the cable. The interface between the contacts of the connector and the conductors of the flat multiconductor cable is particularly subject to such adverse effects. Stress placed on the point of connection by movement of the cable in a longitudinal direction, could cause a dislodgement of the conductors from their interconnection with the contacts of the connector.

There are numerous examples of devices which provide cable strain relief in conjunction with ribbon cable connectors. Two such devices are shown in U.S. Pat. Nos. 4,006,957 and 4,295,704. Each of these patents provides for end termination of a flat multiconductor ribbon cable and cable strain relief by clamping a portion of the cable against the upper surface of the connector. While adequate for its intended purposes, these devices fail to provide cable strain relief in "daisy-chain" situations, that is, where plural connectors are desired to be terminated along the length of cable. Subsequent devices have been constructed which provide for cable strain relief for daisy-chain connections. An example of one such strain relief device is found in U.S. Pat. No. 5,011,430. The device shown therein permits daisy-chain connection of connectors to multiconductor ribbon cable while providing strain relief to the cable. Also, since the device in the '430 patent provides strain relief against the sides of the connector, it greatly reduces the height of the connector assembly, which is advantageous in certain situations. However, where height requirements are not critical, or where the height of the connector assembly is intentionally increased so as to provide a pull-tab which facilitates insertion and removal of the connector into a mated part, the multicomponent strain relief device of the '430 patent may not be necessary.

It is therefore desirable to provide a cable strain relief device which is used in combination with an electrical connector, and which would provide cable strain relief to the cable while permitting daisy-chain connections thereto. Also, it is desirable to provide a cable strain relief device for an electrical connector which may be incorporated with a pull-tab for the connector while still permitting daisy-chain connection to the cable.

SUMMARY OF THE INVENTION

It is therefore an object of the present invention to provide an electrical connector assembly which provides strain relief to a multiconductor ribbon cable terminated to the connector of the assembly.

It is a further object of the present invention to provide an electrical connector assembly which permits the daisy-chain termination of the ribbon cable, while providing strain relief therefore.

It is a still further object of the present invention to provide an electrical connector assembly which incorporates cable strain relief with a pull-tab which permits insertion and removal of the connector with a mating component. In the efficient attainment of these and other objects the present invention provides, an electrical connector for terminating a flat elongate multiconductor ribbon cable. The connector includes a connector base having opposed upper and lower surfaces. A plurality of insulation displacing contacts are supported by the base. A cover is movably supported over the base, and is movable with respect thereto to effect movement of the cable into insulation piercing connection with the contacts. A strain relief member is movably supported over the cover. The strain relief member includes a containment bar for containment a portion of the cable between the containment bar and the cover. The strain relief device further includes an elongate slot for insertable receipt of the cable and for supporting a further extent of the cable.

As shown by way of a preferred embodiment herein, the present invention provides an interconnection assembly for providing socketable connection of a flat multiconductor cable to an electrical component. The assembly includes a socket connector including a socket base which supports plural insulation displacing electrical contacts therein. A cover is movably supported over the socket base and accommodates a first transverse extent of cable therebetween. The cover is movable toward the socket base to urge the cable into insulation piercing connection with the contacts. A strain relief member is movably supported over the cover and includes a containment bar spaced from the cover for supporting a second transverse extent of the cable between the cover and the containment bar. The strain relief member is movable towards the cover to engage the second transverse extent of the cable between the containment bar and the cover. The strain relief member further includes a cable entry slot positioned above the containment bar for insertable receipt of the cable and for supporting a third transverse extent of the cable thereat. The interconnection assembly further includes a header connector for insertable and removable receipt of the socket connector. The header connector includes a header base having a central cavity for receiving the socket connector and plural electrical terminals therein. Insertion of the socket connector into the header connector establishes electrical connection between the contacts of the socket connector and the terminals of the header connector.

In a further detailed aspect of the present invention, the strain relief member also incorporates a pull-tab to permit ease of insertion and removal of the socket connector into the header connector.

In its method aspect, the present invention provides strain relief to elongate flat multiconductor cable having opposed ends and a central transverse extent terminated between a cover and a base of an electrical connector. The method includes the steps of folding the cable over the cover so that a further transverse extent overlies the cover. Also, the method includes providing a strain relief device having means for removable attachment of device to the cover. The strain relief device further includes a containment bar for disposition over the cover and a further cable receiving slot. The strain relief device is attached to the base over the cover, so as to support a further transverse extent of the cable between the containment bar and the cover. Then, an end of the cable is inserted into the cable entry slot and the end is pulled through the slot so that an additional transverse extent of the cable is supported within the slot.

DETAILED DESCRIPTION OF THE PREFERRED EMBODIMENTS

Figure 1:
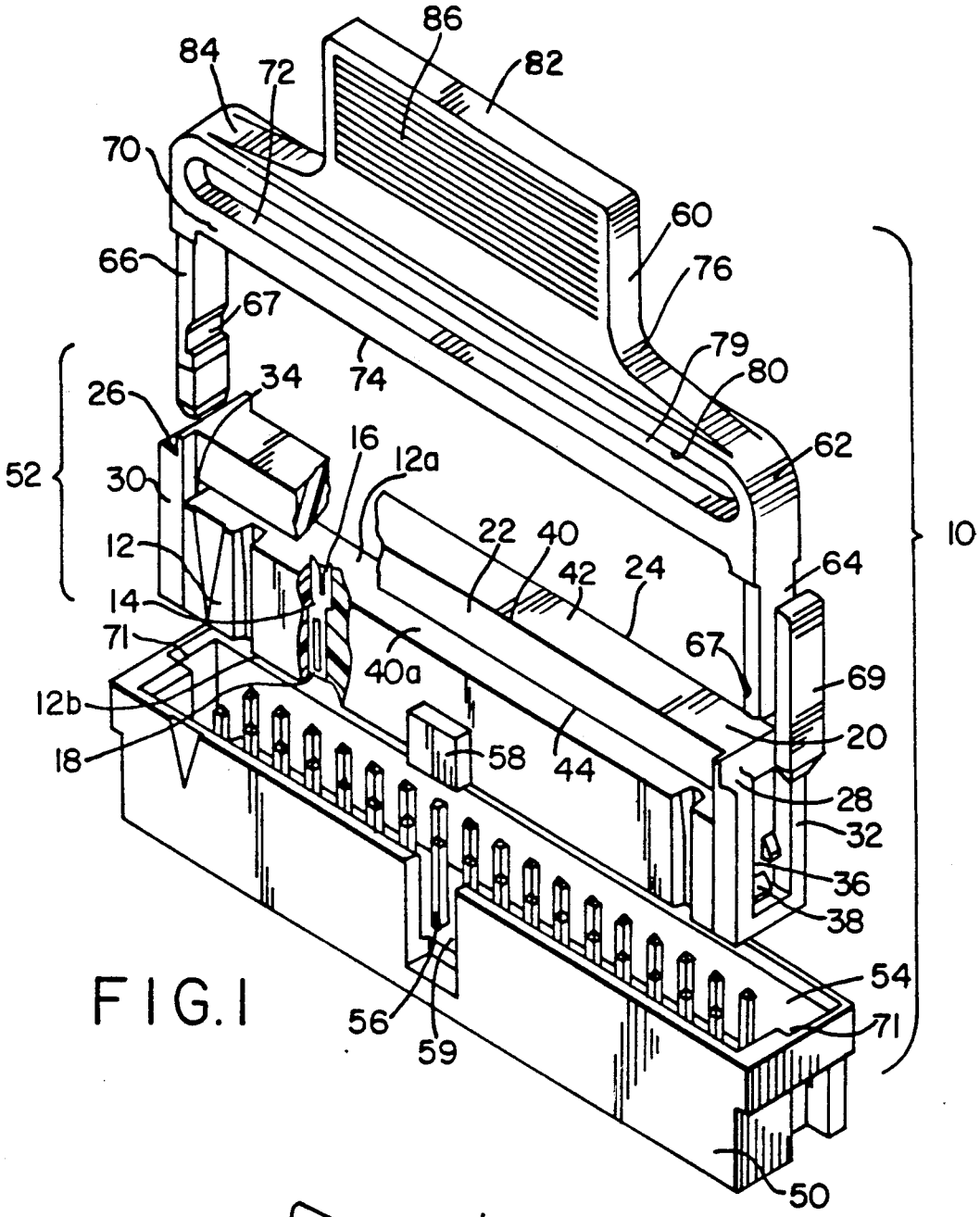
FIG. 1 shows an exploded perspective view, partially in section, of the connector assembly of the present invention.
Figure 2:
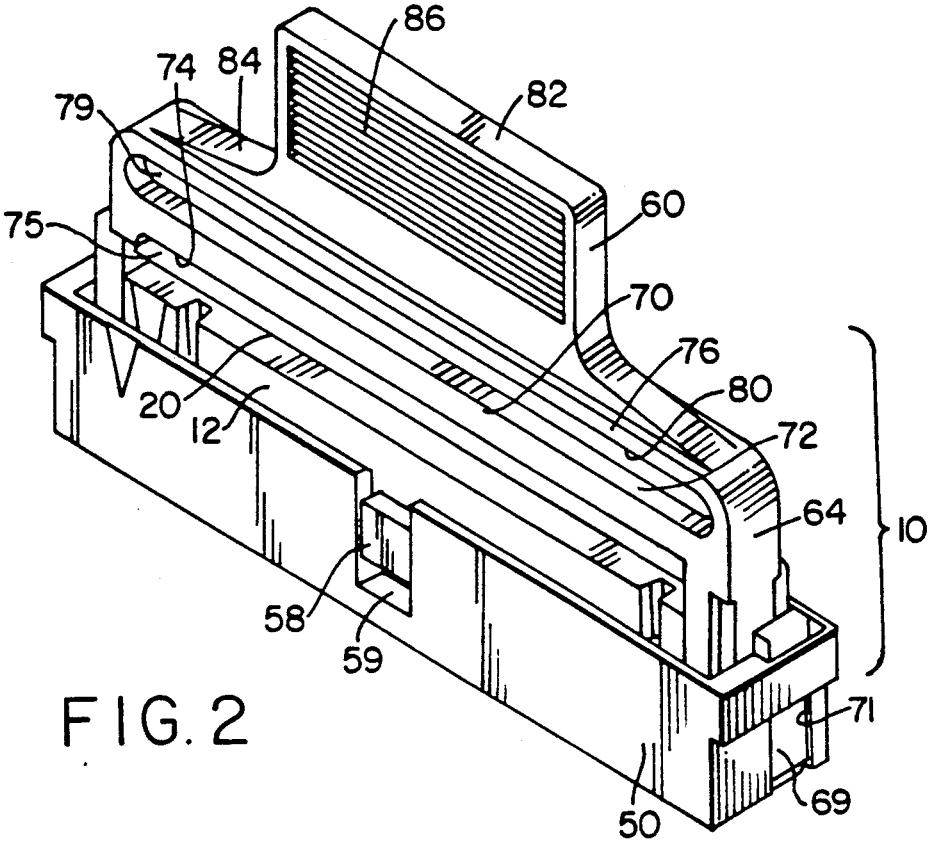
FIG. 2 shows in perspective view the assembled connector assembly of FIG. 1.

Referring to FIGS. 1 and 2, electrical connector assembly 10 of the present invention is employed to terminate flat multiconductor ribbon cable 11 (FIGS. 4 through 8). Connector assembly 10 includes an elongate connector base 12 comprised of electrically insulative plastic. Base 12 supports a plurality of electrical contacts 14, one of which is shown in FIG. 1. Contacts 14 are fixably positioned within base 12, typically in plural longitudinally extending rows.

Each contact 14 includes an upper insulation displacing end 16, which extends above an upper base surface 12*a*. Contact 14 includes a lower termination end 18 positioned adjacent a lower base surface 12*b*. Lower base surface 12*b* and the termination ends 18 of contacts 14 are designed for electrical interconnection with another electrical component, as will be described in greater detail hereinbelow.

Insulation displacing ends 16 of contacts 14 may be similar to those of conventional construction and of the type used to electrically terminate conductors of flat multiconductor ribbon cable 11. Contacts 14 of this type are widely used in electrical connectors to facilitate easy mass termination of cable 11.

Connector assembly 10 further includes a cover 20 which is an elongate member formed of insulative plastic extending longitudinally with base 12. Cover 20 includes a pair of opposed longitudinal sidewalls 22 and 24, and transverse end walls 26 and 28. Cover 20 further includes depending latch arms 30 and 32 extending from transverse end walls 26 and 28 respectively. Latch arms 30 and 32 cooperatively engage with transverse ends 34 and 36 of base 12 to permit movable latching engagement of cover 20 with base 12. Transverse ends 34 and 36 of base 12 include latch elements 38 which provide for the dual position latching of cover 20 to base 12. Extending between transverse end walls 26 and 28, cover 20 includes a longitudinal cover extent 40. Cover extent 40 includes an upper cover surface 42 and an opposed lower cover surface 44. Lower cover surface 44 may include undulations therealong (not shown) which engage flat multiconductor ribbon cable 11, as is known in the insulation displacing connection art.

Connection of contacts 14 to ribbon cable 11 is accomplished in a region 40*a* defined between lower surface 44 of cover 20 and upper surface 12*a* of base 12. Such connection may be achieved adjacent one end of ribbon cable 11 or may be accomplished along a central extent thereof (see FIG. 8). Termination in this manner allows cable 11 to be daisy-chain connected to additional connectors along its longitudinal extent.

With cable 11 positioned in region 40*a*, (see also FIG. 4) termination is achieved by moving cover 20 downward towards base 12 from an upper latched position to a lower latched position. A suitable tool (not shown) may be used to achieve such movement.

Electrical connection assembly 10 further includes a header connector 50 designed for mating interconnection with base 12 and cover 20 which may be collectively referred to as socket connector 52. Header connector 50 is an elongate electrically insulative plastic member having a central cavity 54 which receives base 12 of socket connector 52. Header connector 50 supports a plurality of electrical terminals 56 which are arranged in a pattern that is complimentary to that of contacts 14. Insertable receipt of socket connector 52 into header connector 50 establishes electrical engagement between contacts 14 and terminals 56. Header connector 50 may be mounted to a printed circuit board (not shown) or the like, so that insertable and removable electrical connection may be established between cable 11 and the traces on the printed circuit board.

Socket connector 52 and header connector 50 may include cooperative polarization devices such as projection 58 and slot 59 which facilitate the proper insertion of socket connector 52 into header connector 50. Such engagement is particularly shown in FIG. 2.

In order to facilitate easy insertion and removal of socket connector 52 into header connector 50, a pull-tab device 60 may be employed. Pull-tab device 60, in addition to serving its function of permitting easy insertion and withdrawal of socket connector 52 into header connector 50 also provides strain relief for the connection of ribbon cable 11 to contacts 14.

Pull-tab device 60 includes an elongate body 62 formed of insulative plastic. Body 62 includes at each longitudinal end thereof spaced-apart depending legs 64 and 66. Legs 64 and 66 include latch mechanisms 67 which cooperatively engage with transverse end walls 26 and 28 of base 12 to secure pull-tab device 60 to socket connector 52. Depending legs 64 and 66 may also include a polarization key 69 which cooperates with corresponding recesses 71 within cavity 54 of header connector 50 so as to provide an additional polarization feature for the insertion of socket connector 52 into header connector 50. The cooperation of polarization key 69 with recess 71 of header connector 50 is shown in FIG. 2.

Figure 3:
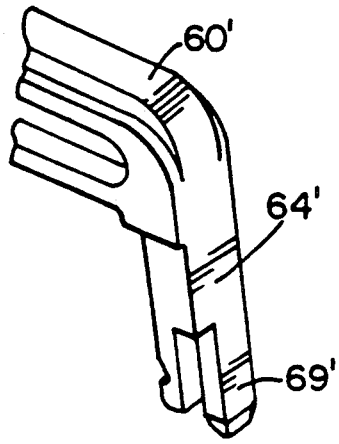
FIG. 3 is a partially fragmented perspective view of an additional embodiment of the present invention.

FIG. 3 shows a more preferred embodiment of the polarization feature of the connector assembly of present invention. Polarization key 69' may be incorporated directly into one of depending legs 64' of pull-tab device 60' to serve a similar function.

Pull-tab device 60 further includes a longitudinally extending containment bar 70 extending between depending legs 64 and 66. Containment bar 70 includes an upper containment bar surface 72 and an opposed lower containment bar surface 74. As will be explained in greater detail hereinbelow, lower containment bar surface 74 cooperates with upper surface 42 of cover 20 to frictionally support a transverse extent of cable 11 therebetween. As shown in FIG. 2, lower containment bar surface 74 and upper cover surface 42 define a region 75 therebetween which accommodates cable 11.

Region 75 is optimally designed to have a height which is slightly less than the height of cable 11 so that cable 11 is frictionally retained between lower containment bar surface 74 of containment bar 70 and upper surface 42 of cover 20. However, as there may exist slight variations between the heights of various cables, some cables could be compressibly clamped between containment bar 75 and cover 20 while other cables merely frictionally held thereby.

Pull-tab device 60 further includes a longitudinal beam 76 extending between legs 64 and 66 above containment bar 70. Beam 76 is spaced from the upper surface 72 of containment bar 70 so as to define an elongate slot 79 therebetween. Slot 79 is defined by upper surface 72 of containment bar 70 and a lower surface 80 of beam 76. Slot 79 is positioned to receive an end of cable 11, which as will be described in further detail hereinbelow, is inserted therethrough. Slot 79 has a height which is slightly greater than the height of cable 11 to facilitate entry of the cable therethrough.

Pull-tab device 60 further includes an extending projection 82 which extends from an upper surface 84 of beam 76. Projection 82 permits a user to manually grasp strain relief device 60, which is attached to socket connector 52 to facilitate insertion and removal of socket connector 52 from header connector 50. Gripping ribs 86 may be included along projection 82 to assist in the manual grasping thereof. Also, an upper edge 88' of projection 82 may be outwardly flared to further assist grasping (see FIG. 8).

Having described the structure of connector assembly 10 of the present invention, its use and operation may now be described.

Figure 4:
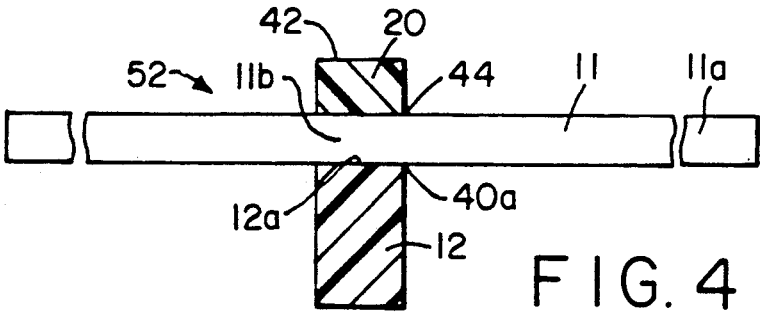

Referring initially to FIG. 4, cable 11 is placed between base 12 and cover 20 of socket connector 52. As shown in FIG. 4, a central transverse extent 11*b* of cable 11 is positioned in region 40*a* between the undersurface 44 of cover 20 and the upper surface 12*a* of base 12. It, however, may be understood that the present invention may be practiced by placing an extent of cable 11 adjacent an end 11*a* thereof, between cover 20 and base 12. Cable 11 is terminated to socket connector 52 in a manner described above and well known in the insulation displacing electrical connector art.

Figure 5:
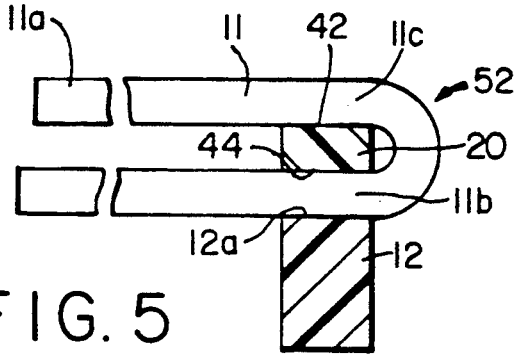

Referring now to FIG. 5, the next step is shown. Cable 11 is bent back over cover 20 so that a further transverse extent 11*c*, spaced from extent 11*b* of cable 11, directly overlies upper surface 42 of cover 20. End 11*a* now extends in a direction opposite that shown in FIG. 4.

Figure 6:
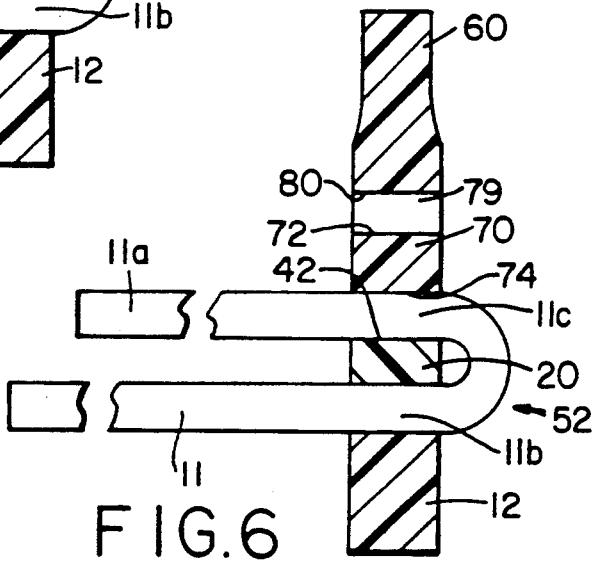

Referring to FIG. 6, pull-tab device 60 is attached to socket connector 52. Transverse extent 11*c* of cable 11 is secured between lower containment bar surface 74 of containment bar 70 and upper surface 42 of cover 20. As the region 75 between lower containment bar surface 74 and upper surface 42 has a height which is designed to be slightly less than that of cable 11, cable 11 will be either compressed at extent 11*c* or frictionally retained therein.

Cable 11 is again folded over and end 11*a* is then inserted through slot 79 above containment bar 70. The height of slot 79 being slightly greater than the height of cable 11, entry of end 11*a* therethrough will be easily facilitated.

Figure 7:
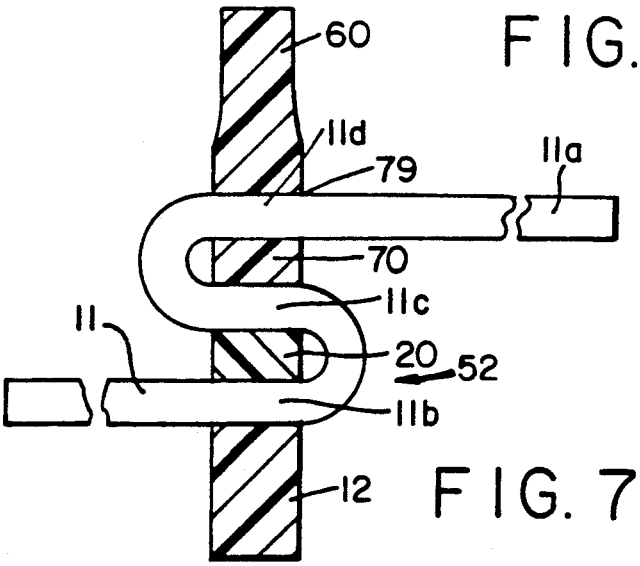

Referring to FIG. 7, end 11*a* is pulled through slot 79 until it is relatively taught. End 11*a* will now extend in the direction as originally shown in FIG. 4. A further central extent 11*d* of cable 11 will be held within slot 79. As end 11*a* extends beyond socket connector 52 in the same direction as originally shown in FIG. 4, cable 11 may be subsequently termineated anywhere along its length between transverse extent 11*d* and end 11*a* so that the cable 11 may be daisy-chain connected to other connectors.

Figure 8:
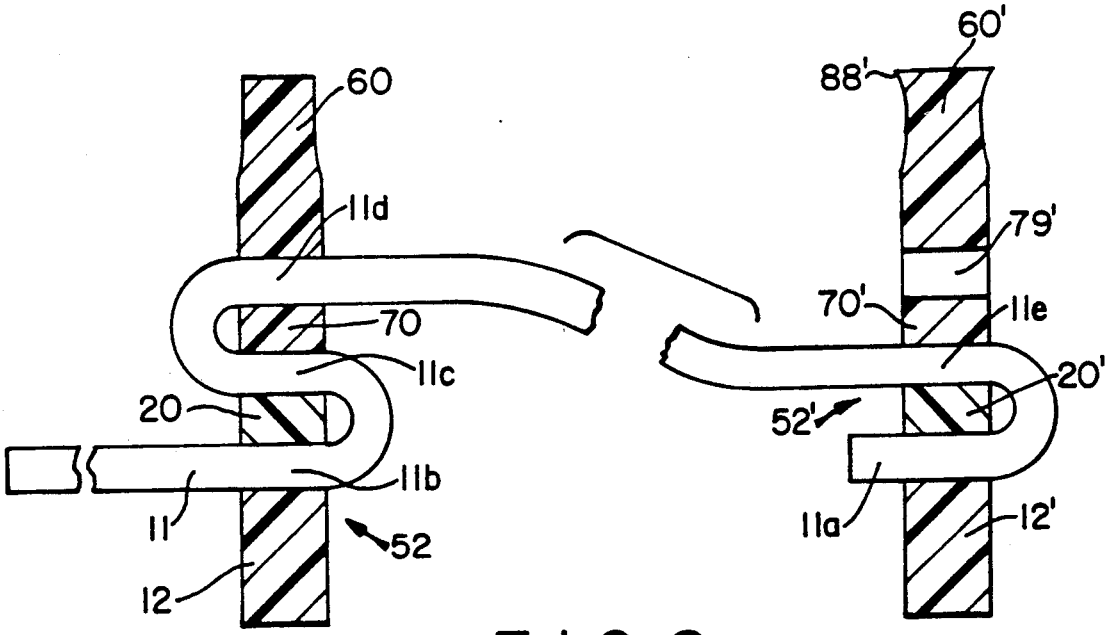
FIGS. 4 through 8 show in schematic section, successive of steps of terminating a flat multiconductor ribbon cable with the connector assembly of the present invention.

Referring to FIG. 8, a daisy-chain connection of cable 11 is shown. The connection described hereinabove is shown on the left hand side of the drawing while an end termination, that is, a termination adjacent end 11*a* of cable 11 is shown in the right hand side of FIG. 8. Socket connector 52' terminates a transverse extent of cable 11 adjacent end 11*a*. Pull-tab 60' is inserted over cover 20' as described hereinabove. Since an end termination is achieved, there is no need to pull the end 11*a* through slot 79' of pull-tab member 60'. It, of course, may be appreciated that several daisy-chain connections may be accomplished along the length of cable 11 in a manner described herein.

Various changes to the foregoing described and shown structures would now be evident to those skilled in the art. Accordingly, the particularly disclosed scope of the invention is set forth in the following claims.

I claim:

1. An electrical connector for terminating a flat elongate multiconnector cable comprising:

an elongate connector base having opposed upper and lower base surfaces;

a plurality of contacts fixedly positioned in said base having insulation-piercing extents extending above said upper base surface and connection extents adjacent said lower base surface;

an elongate cover movably supported over said base adjacent said upper base surface for supporting a transverse extent of said cable therebetween, said cover having transverse ends, an upper cover surface and opposed lower cover surface facing said upper surface of said base, movement of said cover toward said base effecting insulation-piercing connection of said first transverse extent of said cable to said contacts; and an elongate strain relief member movably supported over said cover, said strain relief member having transverse end walls for engagement with said connector base and an elongate containment bar therebetween, said containment bar having an upper bar surface and an opposed lower bar surface facing said upper cover surface, movement of said strain relief member toward said cover effecting frictional engagement of a second transverse extent of cable spaced from said first transverse extent, between said lower bar surface and said upper cover surface, said strain relief member further including an elongate slot for insertable receipt of cable and for supporting a third transverse extent of said cable therein.

2. An electrical connector of claim 1 wherein said strain relief member further includes an elongate beam extending between said strain relief transverse end walls, said beam being spaced from said containment bar, said slot being defined between said containment bar and said beam.

3. An electrical connector of claim 2 wherein said beam includes an upper beam surface and an opposed lower beam surface, said lower beam surface facing said upper containment bar surface, said lower beam surface and said upper containment bar surface adapted for engagement with said third transverse extent of said cable.

4. An electrical connector of claim 3 wherein said upper beam surface includes an upwardly extending projection.

5. An interconnection assembly for providing socketable connection of a flat multiconnection cable to an electrical component comprising:

a socket connector including:

a socket base having an upper base surface and an opposed lower base surface;

plural electrical contacts supported by said socket base, said contacts having insulation displacing extents adjacent said upper base surface and connection extents adjacent said lower base surface; and a cover movably supported over said socket base for accommodating a first transverse extent of said cable therebetween, said cover being movable toward said socket base to urge said cable into insulation displacing connection with said contacts;

a strain relief member movably supported over said cover, said strain relief member including a containment bar spaced from said cover for supporting a second transverse extent of said cable spaced from said first transverse extent therebetween, said member being movable toward said cover to support said second transverse extent of cable between said containment bar and said cover, said strain relief member further including a cable entry slot positioned above said containment bar for insertably receiving said cable and for supporting a third transverse extent of said cable thereat; and a header connector for insertable and removable receipt of said socket connector including:

a header base having a central cavity for receipt of said socket connector; and plural electrical terminal elements supported by said header base, said terminal elements having upper extents for electrical engagement with said connection extent of said socket connector and lower extents for electrical engagement with said electrical component.

6. An assembly of claim 5 wherein said strain relief device includes an upwardly extending projection for manual grasping by a user to facilitate said insertable and removable receipt of said socket containment in said header connector.

7. An assembly of claim 6 wherein said containment bar of said strain relief device includes opposed upper and lower containment bar surfaces, said lower containment bar surface engaging said second transverse extent of said cable upon movement of said strain relief device toward said cover.

8. An assembly of claim 7 wherein said strain relief device further includes a beam spaced from said containment bar upper surface said beam and said containment bar upper surface defining said slot.

9. An assembly of claim 8 wherein said beam and said containment bar upper surface are adapted to frictionally engage said third transverse extent of said cable.

10. An assembly of claim 9 wherein said upwardly extending projection extends from said beam.

11. An assembly of claim 5 wherein said strain relief member includes a pair of spaced apart legs, each leg depending from opposed ends of said containment bar, said legs being insertable into said header cavity to facilitate insertion of said socket connector with said header connector.

12. An assembly of claim 11 wherein said header connector includes a pair of spaced apart recesses in communication with said cavity for receipt of said legs of said strain relief member.

13. An assembly of claim 12 wherein said legs of said strain relief member and said recesses of said header connector includes cooperative polarization means for preventing incorrect insertion of said socket connector with said header connector.

14. A method of providing strain relief to an elongate flat multiconnector cable having opposed ends and a first transverse extent terminated between a cover and a base of an electrical connector comprising the steps of:

folding said cable over said cover so that a second transverse extent of said cable, spaced from said transverse extent overlies said cover;

providing a strain relief device having means for movable attachment of said strain relief device over said cover, a containment bar for deposition over said cover and a cable receiving slot;

attaching said strain relief device to said base over said cover to support said second transverse extent of said cable between said containment bar and said cover;

inserting an end of said cable into said slot, said end being closer to said second transverse extent than to said first transverse extent; and pulling said end through said slot so that a third transverse extent of said cable between said end and said second transverse extent of said cable is supported within said slot.

* * * * *